US007175392B2

(12) United States Patent
Steiner

(10) Patent No.: US 7,175,392 B2
(45) Date of Patent: Feb. 13, 2007

(54) CEILING FAN MOTOR WITH STATIONARY SHAFT

(76) Inventor: Robert E. Steiner, 1760 Horseshoe Ridge, Chesterfield, MO (US) 63005

( * ) Notice: Subject to any disclaimer, the term of this patent is extended or adjusted under 35 U.S.C. 154(b) by 95 days.

(21) Appl. No.: 11/028,830

(22) Filed: Jan. 4, 2005

(65) Prior Publication Data

US 2006/0147310 A1 Jul. 6, 2006

(51) Int. Cl.
*F04D 29/34* (2006.01)

(52) U.S. Cl. ..... 416/134 R; 416/170 R; 416/210 R; 416/244 R; 416/500

(58) Field of Classification Search ..... 416/5, 416/170 R, 204 R, 205, 206, 207, 210 R, 416/244 R, 500, 134 R; 417/423.1, 424.1
See application file for complete search history.

(56) References Cited

U.S. PATENT DOCUMENTS 1,856,017 A * 4/1932 Baker ..... 416/5
2,488,365 A * 11/1949 Abbott et al. ..... 310/62
2,508,144 A * 5/1950 Carville ..... 416/202
2,678,104 A * 5/1954 Davis ..... 416/134 R
2,690,063 A * 9/1954 Davis ..... 416/134 R
4,438,359 A * 3/1984 Royer ..... 310/68 R
4,511,310 A * 4/1985 Pearce ..... 416/134 R
4,850,799 A 7/1989 Bucher, Sr. et al.
5,464,323 A 11/1995 Scofield
5,944,487 A 8/1999 Pearce
5,954,449 A * 9/1999 Wu ..... 416/206
6,352,411 B1 * 3/2002 Bucher et al. ..... 416/210 R

* cited by examiner

*Primary Examiner*—Christopher Verdier
(74) *Attorney, Agent, or Firm*—Polster, Lieder, Woodruff & Lucchesi, L.C.

(57) ABSTRACT

A ceiling fan motor includes a motor housing having an end wall and a side wall; a stator assembly mounted within the housing; a rotor assembly mounted within the housing to rotate relative to the stator assembly; and a fan blade hub adapted to have fan blades mounted thereto. The fan blade hub includes a central opening and the rotor assembly includes a driving member shaped complementarily to the opening of the fan blade hub. The driving member positively engages the fan blade hub (and hence the fan blades) as the rotor rotates. A grommet is positioned between the fan blade hub and the driving member to vibrationally isolate the fan blade hub from the rotor.

14 Claims, 2 Drawing Sheets

CEILING FAN MOTOR WITH STATIONARY SHAFT

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to ceiling fan motors, and in particular to a ceiling fan motor construction having a stationary central shaft to allow for the passage of wires to, for example, a light fixture suspended from a ceiling fan and which isolates the fan blades from the motor rotor.

Ceiling fans are commonly placed in residences and business establishments to facilitate air movement within rooms. As is known, a ceiling fan motor comprises a stator, a rotor, and blades connected to the rotor to be rotated by the motor. Often, in electrical motors, the rotor is inside the stator. However, many ceiling fans employ an inside-out motor in which the rotor is on the outside and surrounds the stator.

Often an electrical fixture, such as a light fixture, is suspended from a ceiling fan. In this situation, the electrical wires for the electrical fixture pass through the center of the ceiling fan. As can be appreciated, the tube or passage through which the wires pass must be stationary (i.e., must not rotate), otherwise the wires will be twisted, and ultimately will break.

In addition, the connection of the fan blades to the rotor often results in noise. It would be desirable to provide a fan assembly which isolates that fan blades from the rotor to reduce vibration and resulting noise during operation of the fan.

BRIEF SUMMARY OF THE INVENTION

Briefly stated, a ceiling fan motor of the present invention comprises a motor housing defining a generally vertical axis and having an end wall and a side wall, a stator assembly mounted within the housing, a rotor assembly mounted within the housing to rotate relative to the stator assembly; and a fan blade hub to which fan blades are attached. The fan blade hub includes a receptacle, and the rotor includes a drive means about the rotor hub shaped complementarily to the fan blade hub receptacle. The fan blade hub receptacle and drive means are shaped such that the drive means will positively engage the fan blade hub receptacle, such that the fan blade hub will rotate as the rotor rotates relative to the stator. Because the fan blade hub is not fixed directly to the rotor assembly, the fan also include retaining or mounting means to retain the fan blade hub in position relative to the rotor to maintain the engagement of the drive means with the fan blade hub receptacle.

In an illustrative embodiment, the drive means comprises a drive member in the form of one or more ears or projections which extend outwardly from the rotor hub beneath the rotor windings or laminations and the receptacle comprises an opening in the fan blade hub. The nroiections can be evenly sraced about the rotor hub. The fan blade hub opening hence includes slots correspondingly sized and shaped to the rotor hub projections.

The motor also includes an elastomeric member positioned between the drive means and the fan blade hub to vibrationally isolate the fan blade hub from the rotor. The elastomeric member can be in the form of a grommet. The grommet defines an outwardly opening groove which is sized to receive the edge of the fan blade hub opening. The grommet is also sized to fit about the drive means.

The housing is also provided with a central hollow shaft which extends along an axis of the motor. The hollow shaft defines a wire way through which wires can be passed to electrically connect a fixture (such as a light suspended from the ceiling fan) to a source of electricity. In the illustrated embodiment, the rotor assembly is adapted to rotate about the central shaft, and the stator is positioned adjacent the housing outer wall.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
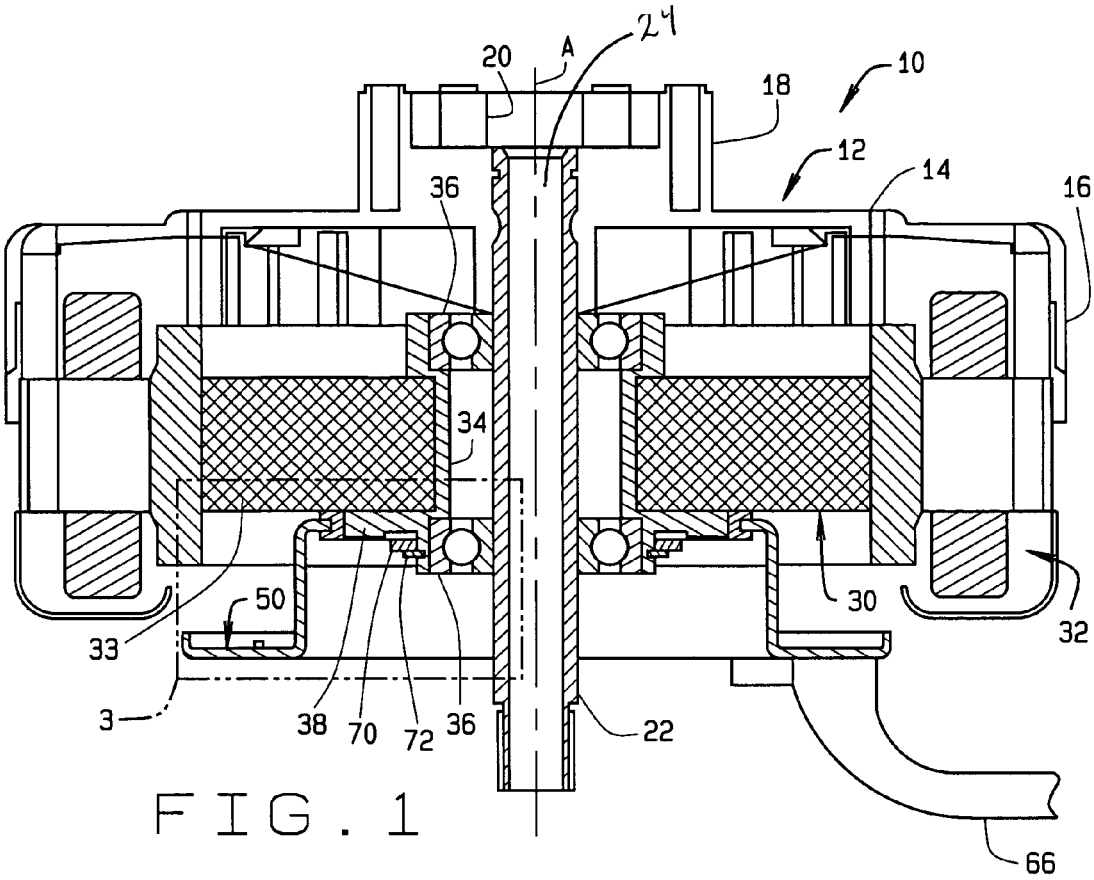
FIG. 1 is a cross-sectional view of an illustrative embodiment of a ceiling fan motor of the present invention.

The following detailed description illustrates the invention by way of example and not by way of limitation. This description will clearly enable one skilled in the art to make and use the invention, and describes what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

An illustrative embodiment of a ceiling fan 10 of the present invention is shown generally in FIG. 1. The ceiling fan 10 includes a generally cylindrical housing 12 having an end wall 14 and an outer wall 16. A mounting portion 18 extends upwardly from the center of the end wall 14 and is adapted to mount the housing 12 (and hence the fan 10) to a bracket mounted, for example, to a ceiling. Such mounting brackets are commonly known to those skilled in the art and are not described herein. A passage 20 extends through the mounting portion 18 and merges into a hollow shaft 22 which extends through the motor housing. The passage 20 and shaft 22 define a wire way 24 which is co-linear and coaxial with the axis A of the housing 12. This shaft 22 is fixed relative to the housing, and hence is a stationary shaft. The housing passage 20 and shaft 22 define a wire way through which wires can pass to connect an electrical fixture (not shown) suspended from the ceiling fan to a source of electricity.

Figure 2:
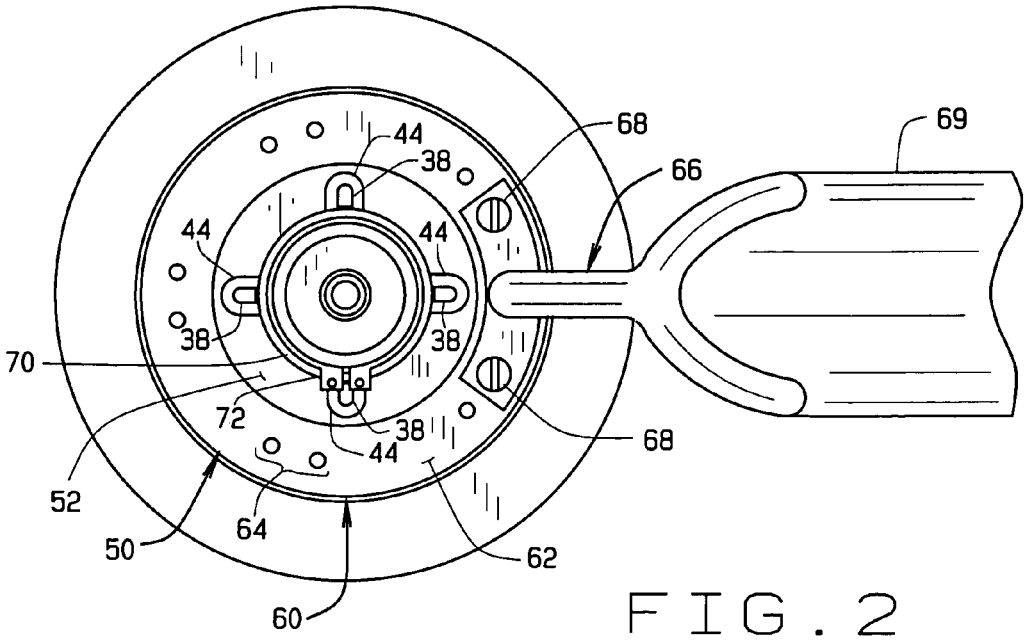
FIG. 2 is a bottom plan view of the ceiling fan motor.

The housing 12 contains a rotor assembly 30 and a stator assembly 32. The stator assembly 32 is located adjacent the housing outer wall 16. The rotor assembly 30 is positioned inside of the stator. The rotor assembly 30 includes windings or laminations 33 mounted about a hub 34 which in turn, is journaled about the shaft 22. Upper and lower bearing assemblies 36 are provided to enable the rotor assembly 30 to rotate about the shaft 22. Ears 38 extend radially outwardly from the rotor hub 34 and extend along a bottom of the rotor windings. There is at least one ear, and preferable two or more ears 38. As seen in FIG. 2, four ears 38 are provided and are spaced apart from each other by about 90°. As will be described below, the ears 38 are provided to connect the ceiling fan's blades through a vibration limiting or dampening material to the rotor, such that the fan blades will be rotated by the rotor. Hence, the ears 38 define a driving member motor.

Figure 3:
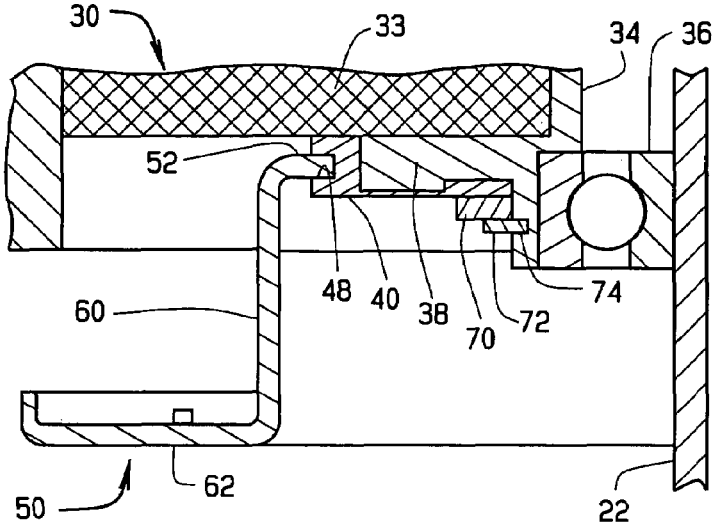
FIG. 3 is an enlarged, fragmentary view of the ceiling fan motor taken along square 3 of FIG. 1.
Figure 4:
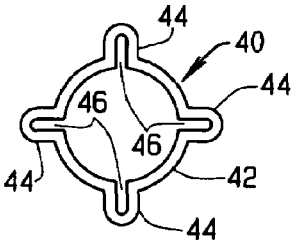
FIG. 4 is a plan view of a grommet of the ceiling fan.

An elastomeric member 40 surrounds the ears 38 and the bottom of the rotor hub 34. The elastomeric member 40 is shown in the drawings to be a grommet. The grommet 40 is shaped to snugly surround the hub 34 and ears 38. The grommet includes a central circular portion 42 having an inner diameter sized to snugly fit about the rotor hub 34 at the bottom thereof. Projections 44 extend from the circular portion 42. The projections 44 define slots 46 having a length and width corresponding generally to the length and width of the ears, such that the projections 44 will snugly surround the ears 38. The grommet 40 includes a number of projections 44 corresponding to the number of ears 38. The illustrative rotor assembly has four ears 38 spaced about 90° apart from each other. Hence, the illustrated grommet 40 includes four projections 44 spaced apart about 90° from each other. As seen in FIG. 3, the grommet 40 has a generally C-shaped configuration in vertical cross-section. Hence, the grommet has an upper surface, a lower surface, and a wall extending between the upper and lower surfaces. The grommet upper and lower surfaces define a radially outwardly opening channel 48 therebetween.

A fan blade hub 50 (FIGS. 5 and 6) includes an end wall 52 having a centrally located receptacle 54. The receptacle 54 is illustratively shown to be an opening in the fan blade hub. The receptacle could alternatively be a cavity or slot in the fan blade hub. The opening 54 corresponds in shape to the grommet 40, and includes a circular portion 56 from which slots 58 extend. The opening 54 is sized so that the grommet wall will fit snugly against the edges of the opening 54. As seen in FIG. 3, the grommet channel 48 fits about the edge of the fan blade hub end wall 52 such that the grommet upper surface overlies a portion of the upper surface of the hub end wall 52 and the grommet lower surface overlies a portion of the lower surface of the hub end wall 52. Thus, the grommet sandwiches the fan blade hub end wall 52 adjacent the opening 54.

Figure 5:
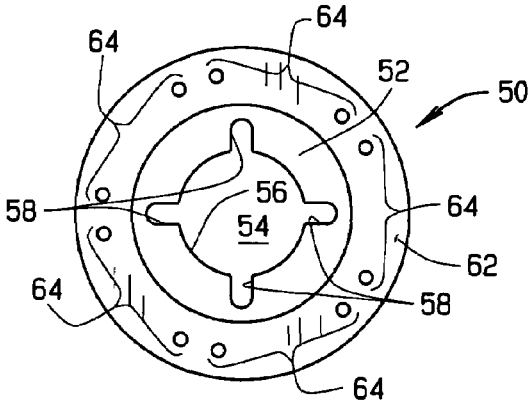
FIG. 5 is a bottom plan view of a fan blade hub of the ceiling fan motor.
Figure 6:
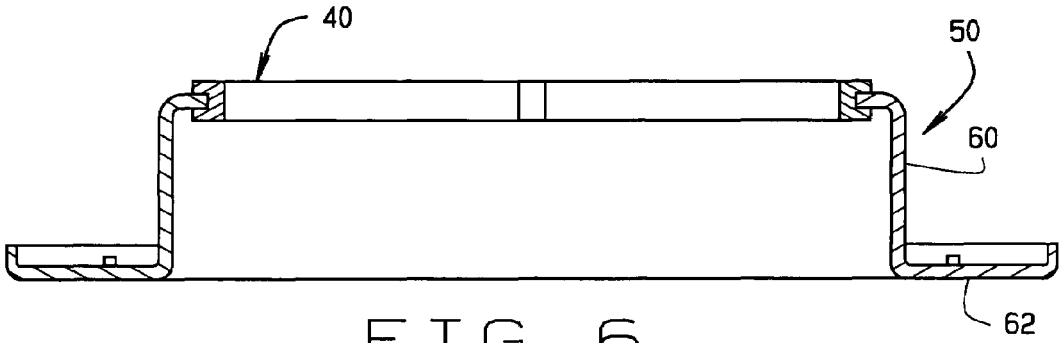
FIG. 6 is a cross-sectional view of the grommet received in the fan blade hub.

A side wall 60 extends downwardly from the peripheral edge of the hub end wall 52. A flange 62 extends outwardly from the bottom of the wall 60. The hub flange 62 is provided with a plurality of hole pairs 64, there being one hole pair 64 for each fan blade which is to be mounted to the motor. FIG. 5 shows five hole pairs 64 to enable five blades to be mounted to the hub 50. The blades are mounted to the hub in any conventional manner. Typically, and as shown in FIG. 2, a blade mount 66 is secured to the blade hub 50, for example, by means of screws 68 which extend through a base of the blade mount 66 and into the blade hub flange 62. A fan blade 69 is then secured to the fan blade mount 66.

The fan blade hub 50 is not secured directly to the rotor assembly 30. Rather, the fan blade hub 50 (and hence the fan blades 69) are driven by the engagement of the rotor ears 38 and the fan blade hub slots 58 via the grommet 40), and the fan blade hub 50 is maintained in place on the shaft 22 by means of a retaining ring 72. A washer 70 is also provided, but could be omitted if the retaining ring had a larger outer diameter. The washer and retaining ring are both sized to fit around the rotor hub 34. The washer 70 has an outer diameter greater than the diameter of the hub opening 54, such that at least a portion of the fan biade hub end wall 52 will be over the washer 70. The retaining ring 72 is received in a groove 74 on the rotor hub 34, and maintains the axial position of the fan blade hub 50 on the rotor hub 34 and maintains the engagement of the rotor hub slots 58 (and grommet 40) with the rotor hub ears 38.

Because the fan blade hub 50 is not directly secured or fixed to the rotor assembly 30, the fan blade hub 50 (and hence the fan blades) are driven by the engagement of the ears 38 with the blade hub 50 (through the grommet 40). Hence the ears 38 define a driving member for the fan blades. Although the use of ears 38, is preferred, many other configurations can be used for the driving member to drive the blade hub 50, and hence the fan blades 69. For example, the ears 38 could be replaced with a polygonal platform which surrounds the rotor hub 34. Such a platform could be square, rectangular, triangular, star shaped, etc. The polygonal shape could be regular or irregular. All that would be necessary is that, in some manner, the drive means can engage the opening 54 in the fan blade hub end plate (and that the opening 54 be shaped complementarily to the drive means) such that the drive means can positively engage the fan blade hub opening, such that the fan blade hub 50 (and hence the fan blades 69) will be rotated by rotation of the rotor assembly 30. As can be appreciated, the ears 38 define a drive means which, as noted above, cause the fan blade hub 50 to rotate as the rotor assembly 30 rotates. Additionally, the retaininci ring 72 defines a retaining or mounting means for mountinci the fan blade hub 50 to the rotor hub without fixing the fan blade hub directly to the rotor hub.

Although a retaining ring is illustrated as being used to maintain the blade hub 50 on the rotor hub 34, other means could be used as well. For example, pins could be provided which would extend outwardly from the rotor hub beneath the blade hub. Alternatively, the blade hub could be modified to include spring mounted pins or balls which would then be received in a groove on the rotor hub. In another alternative, the fan blade hub can be fixed to the rotor assembly by fasteners (such as screws, bolts, etc.) which extend through the fan blade hub and into the rotor assembly. In this instance, grommets would be provided for the fasteners to vibrationally isolate the fan blade hub from the rotor assembly.

The design of the fan motor 10 has at some notable advantages. First of all, the grommet 40 isolates the fan blade hub 50 from the rotor assembly, and thus substantially reduces the vibrations which would otherwise be passed from the rotor through the blade hub, and to the blades. This will allow for a quieter operation of the fan. Secondly, because the blade hub 50 is not directly attached to the rotor 30, the hub 50 can pivot slightly in a plane perpendicular to the motor axis A to allow for automatic correction of out-of-plane blades. Fan blades generally are not perfectly balanced, and some of the fan blades may be slightly heaver than others. If the blade hub 50 were secured or mounted directly to the rotor, this difference in weight of the fan blades would cause the fan to vibrate, and possibly even wobble about the plane perpendicular to the motor axis A. Because the blade hub 50 is not secured or fixed directly to the rotor 30, the out-of-plane fan blades can find their own plane of rotation, which might be slightly angled relative to the plane perpendicular to the motor axis A. Additionally, the wire shaft 20 is fixed to the motor housing 12 allowing for wires, for example for a lighting fixture, to pass through the shaft 20 to power such a fixture.

As various changes could be made in the above constructions without departing from the scope of the invention, it is intended that all matter contained in the above description or shown in the accompanying drawings shall be interpreted as illustrative and not in a limiting sense. For example, although the motor is shown with the rotor rotating inside of the stator, the fan blade hub and grommet could be adapted for use with an inside-out motor in which the rotor surrounds the stator and rotates about the stator (rather than inside of the stator). This example is merely illustrative.

The invention claimed is:

1. A ceiling fan motor comprising:

a motor housing having an end wall and a side wall; said housing defining a generally vertical axis; said housing including a shaft extending from said end wall along said vertical axis;

a stator assembly adjacent said side wall;

a rotor assembly rotatably mounted about said shaft; said rotor assembly comprising a rotor hub about which rotor windings or laminations are mounted;

said rotor hub including a lower portion extending beyond said rotor windings or laminations and a driving member extending from said rotor hub along a bottom of said rotor windings or laminations;

a fan blade hub having an end plate, a side wall extending downwardly from said end plate, and a flange extending outwardly from said fan blade hub side wall;

said fan blade hub end wall plate including an opening correspondingly shaped to said driving member such that said driving member engages said fan blade hub end plate opening whereby said fan blade hub will rotate as said rotor assembly rotates; said fan blade hub flange being adapted to mount fan blades thereto;

a grommet sized and shaped to be positioned between said driving member and an edge of said fan blade hub opening; and a retainer received on said rotor hub to maintain said fan blade hub on said rotor hub.

2. The motor of claim 1 wherein said shaft is hollow and defines a wire way to receive wires for an electrical fixture.

3. The motor of claim 1 wherein said driving member comprises at least one projection extending from said rotor hub.

4. The motor of claim 1 wherein said driving member comprises a plurality of projections extending from said rotor hub.

5. The motor of claim 4 wherein said projections are evenly spaced about said rotor hub.

6. The motor of claim 1 wherein said grommet is generally C-shaped in vertical cross-section, said cirommet including an upper wall and a lower wall joined by a web; said upper and lower grommet walls overlying a portion of said fan blade hub end plate adjacent said fan blade hub opening to sandwich said fan blade hub end plate adjacent the fan blade hub opening, said grommet vibrationally isolating said fan blade hub from said rotor assembly.

7. A ceiling fan motor comprising:

a motor housing having an end wall and a side wall;

a stator assembly mounted within said housing;

a rotor assembly mounted within said housing to rotate relative to said stator assembly; said rotor assembly comprising a rotor hub about which rotor windings or laminations are mounted; said rotor assembly including a lower portion;

a fan blade hub having an end plate: said fan blade hub being adapted to have fan blades mounted thereto; and mounting means for mounting said fan blade hub to said rotor hub without fixing said fan blade hub directly to said rotor hub and drive means for driving said fan blade hub such that said fan blade hub rotates as said rotor assembly rotates;

said drive means comprising a dilve driving member extending from said rotor hub below said rotor windings or laminations and an opening in said fan blade end plate correspondingly shaped to said driving member such that said driving member engages said fan blade hub end wall plate opening whereby said fan blade hub will rotate as said rotor assembly rotates.

8. The motor of claim 7 wherein said means for mounting said fan blade hub to said rotor hub comprises a retainer.

9. The motor of claim 7 including an elastomeric member sized and shaped to be positioned between said drive means and an edge of said fan blade hub.

10. The motor of claim 7 wherein said driving member comprises at least one projection extending from said rotor hub.

11. The motor of claim 7 wherein driving member comprises a plurality of projections extending from said rotor hub.

12. The motor of claim 11 wherein said projections are evenly spaced about said rotor hub.

13. The motor of claim 7 including a grommet sized and shaped to be received between the driving member and said opening of said fan blade end plate.

14. The motor of claim 13 wherein said grommet includes an upper wall positioned between an upper surface of said fan blade hub end plate and a lower surface of said rotor assembly.

* * * * *

UNITED STATES PATENT AND TRADEMARK OFFICE

CERTIFICATE OF CORRECTION

PATENT NO. : 7,175,392 B2
APPLICATION NO. : 11/028830
DATED : February 13, 2007
INVENTOR(S) : Robert E. Steiner It is certified that error appears in the above-identified patent and that said Letters Patent is hereby corrected as shown below:

Col. 1, Line 66
Replace "nrojections"
with --projections--

Col. 1, Line 67
Replace "sraced"
with --spaced--

Col. 5, Line 38
After the word "end", and before
the word "plate", delete the word "wall"

Col. 6, Line 4
Replace "cirommet"
with --grommet--

Col. 6, Line 27
After the word "a" and before
The word "driving", delete the word
" dilve"

Col. 6, Line 32
After the word "end", and before
the word "plate", delete the word "wall"

Signed and Sealed this

Twenty-ninth Day of May, 2007

JON W. DUDAS
*Director of the United States Patent and Trademark Office*